US007798732B2

(12) United States Patent
Moriyama et al.

(10) Patent No.: US 7,798,732 B2
(45) Date of Patent: Sep. 21, 2010

(54) PRINTING APPARATUS CONTAINING A HARMONIZATION CHANGING PORTION WHICH CHANGES FEEDING SPEED BASED ON PROPERTIES OF THE PRINT RECEIVING MEDIUM

(75) Inventors: Satoru Moriyama, Iwakura (JP); Koshiro Yamaguchi, Kakamigahara (JP); Takamine Hokazono, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 12/220,694

(22) Filed: Jul. 25, 2008

(65) Prior Publication Data

US 2009/0033021 A1 Feb. 5, 2009

(30) Foreign Application Priority Data

Aug. 2, 2007 (JP) ..... 2007-202242

(51) Int. Cl.
*B41J 11/44* (2006.01)

(52) U.S. Cl. ..... 400/76; 400/56; 400/578; 400/611; 400/613; 400/583; 400/583.3

(58) Field of Classification Search ..... 400/56, 400/611, 613, 902, 578, 583.3; 242/485.4
See application file for complete search history.

(56) References Cited

U.S. PATENT DOCUMENTS

| | | | | |
|---|---|---|---|---|
| 5,813,773 | A * | 9/1998 | Kawai | 400/207 |
| 5,980,133 | A * | 11/1999 | Nunokawa et al. | 400/61 |
| 6,386,770 | B1 * | 5/2002 | Nagai et al. | 400/56 |
| 2006/0133650 | A1 | 6/2006 | Xie et al. | |
| 2007/0171447 | A1 | 7/2007 | Schoedinger et al. | |

FOREIGN PATENT DOCUMENTS

| | | | |
|---|---|---|---|
| JP | 2005149427 | A * | 6/2005 |
| JP | 2005297348 | A * | 10/2005 |
| JP | 2006309557 | | 11/2006 |
| WO | WO2006/077942 | A1 | 7/2006 |

* cited by examiner

*Primary Examiner*—Judy Nguyen
*Assistant Examiner*—Matthew G Marini
(74) *Attorney, Agent, or Firm*—Day Pitney LLP

(57) ABSTRACT

This disclosure discloses a printing apparatus comprising a feeding device that applies a driving force to feed a print-receiving medium; a print forming device that performs a print forming process on the print-receiving medium; a harmonization controlling portion that harmonizes and controlling a driving speed of the feeding device and the print forming process operation of the print forming device, based on an input of print information by using a predetermined harmonization correlation; and a harmonization changing portion that changes the harmonization correlation according to properties of the print-receiving medium or a bonding medium to be bonded thereto.

16 Claims, 14 Drawing Sheets

[FIG. 1]
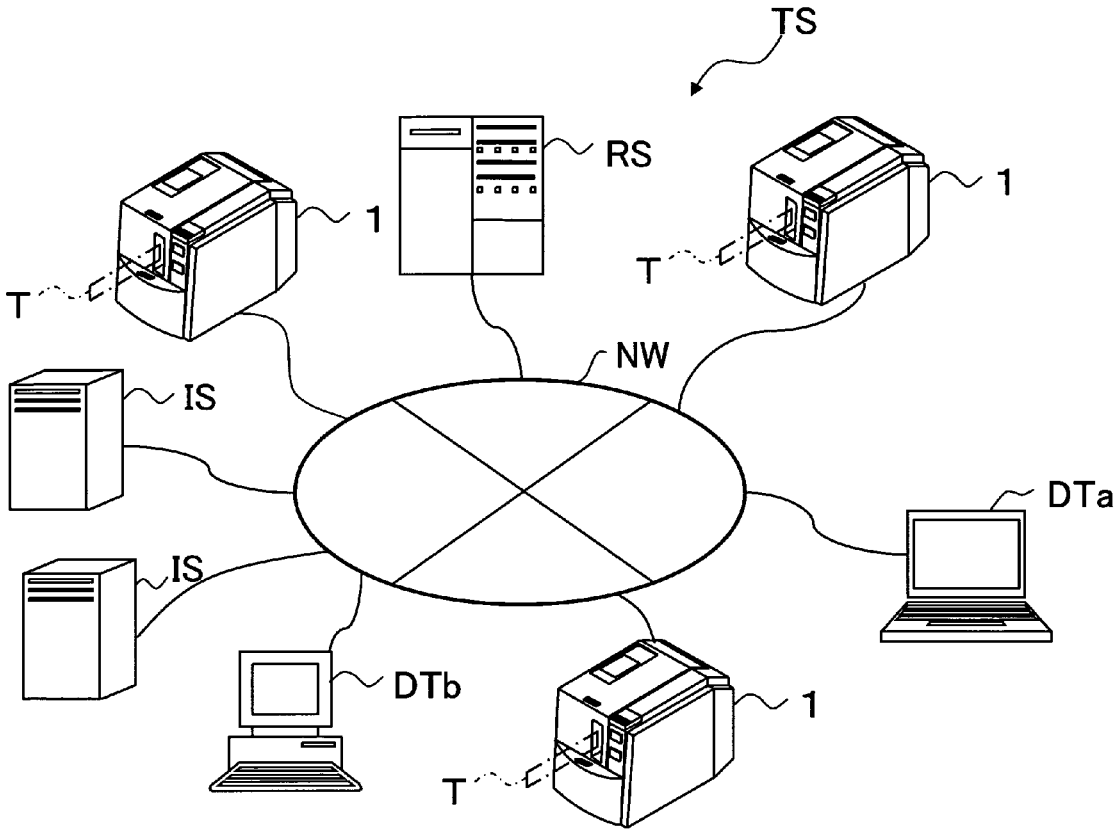

[FIG. 2]
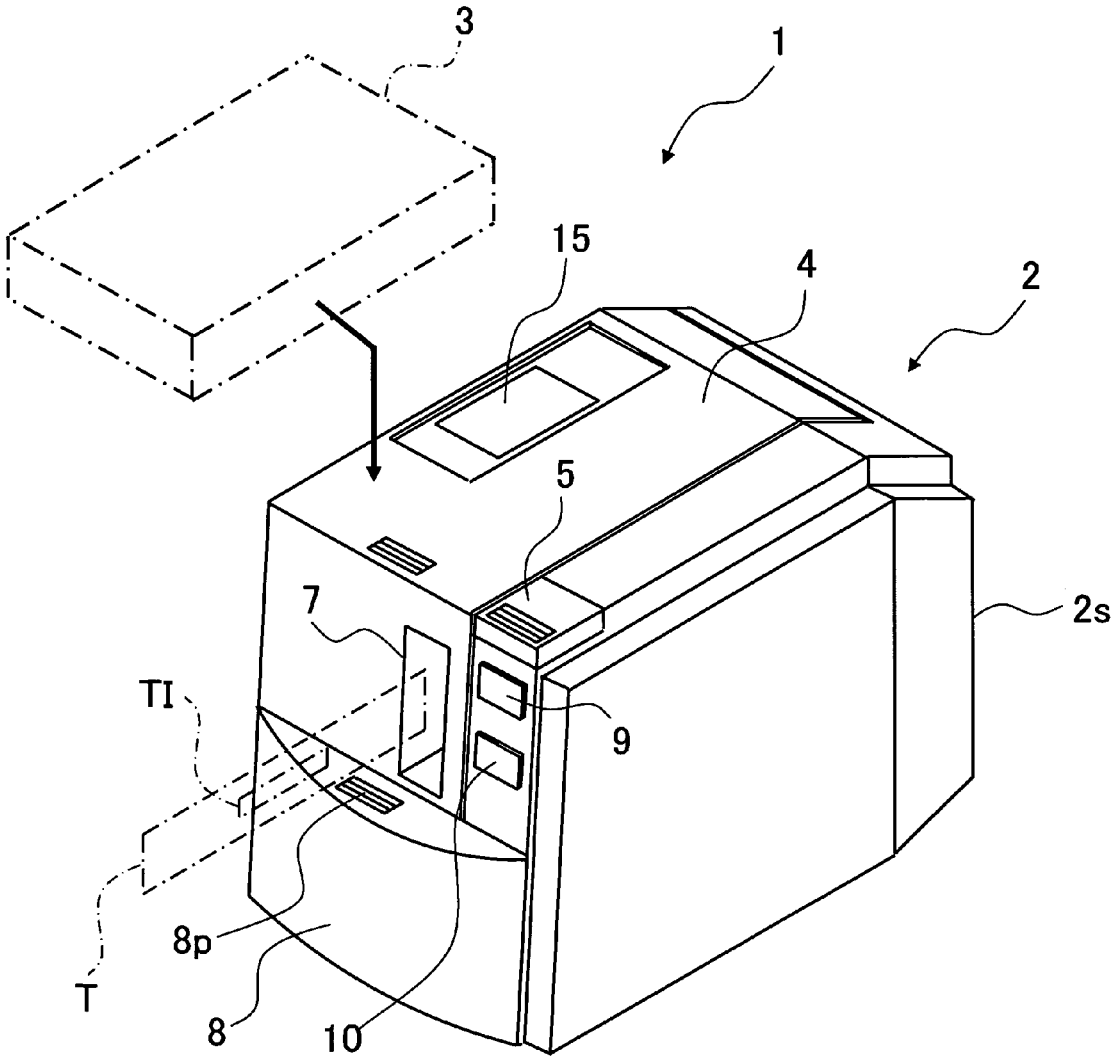

[FIG. 3]
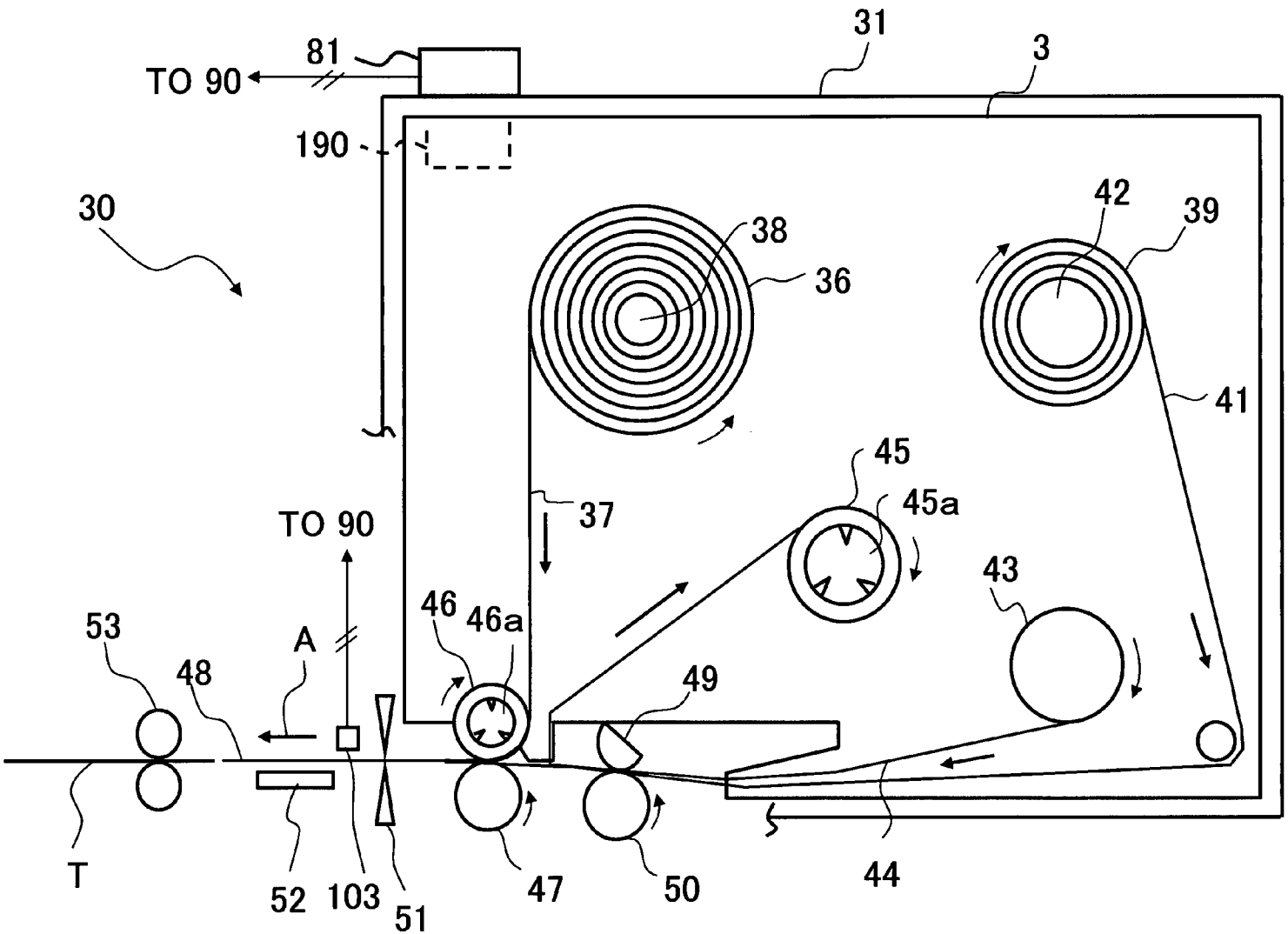

[FIG. 4]
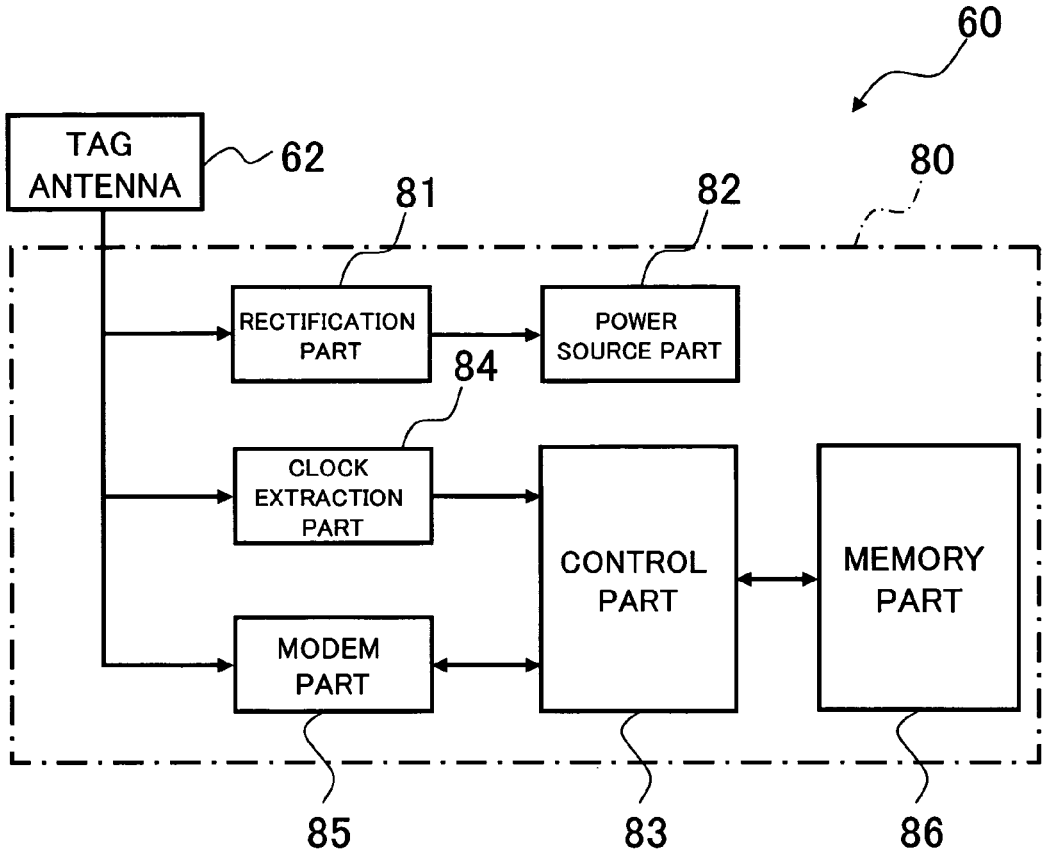

[FIG. 5]
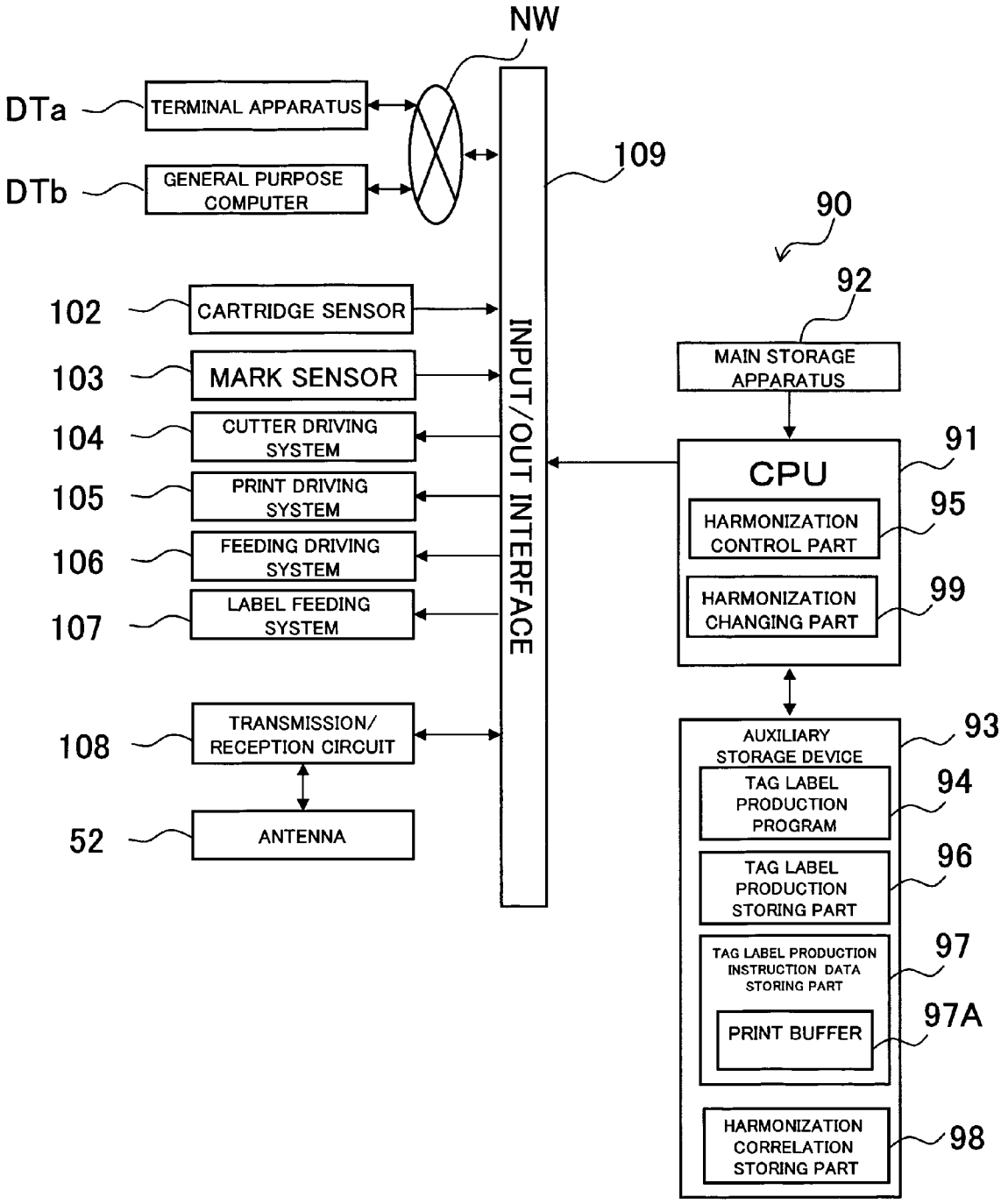

[FIG. 6]
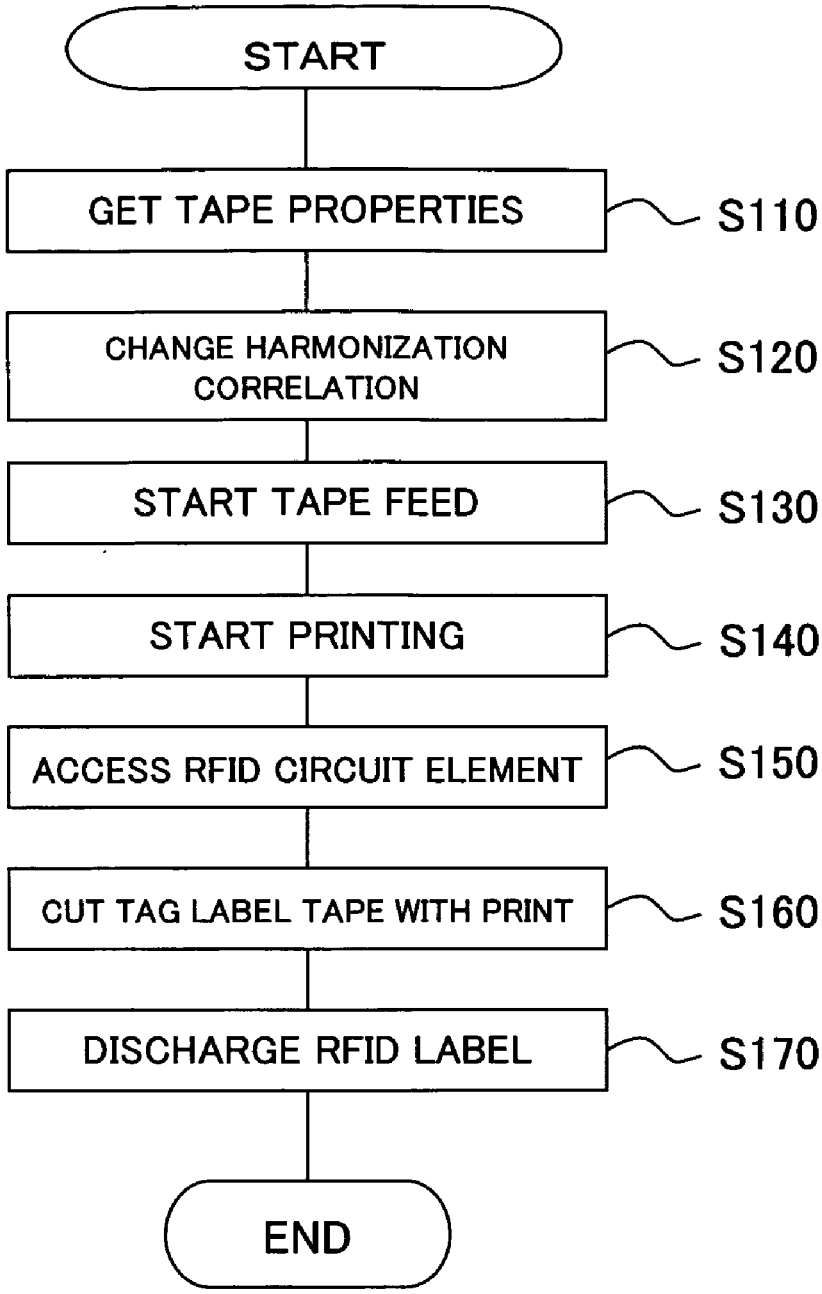

[FIG. 7A]
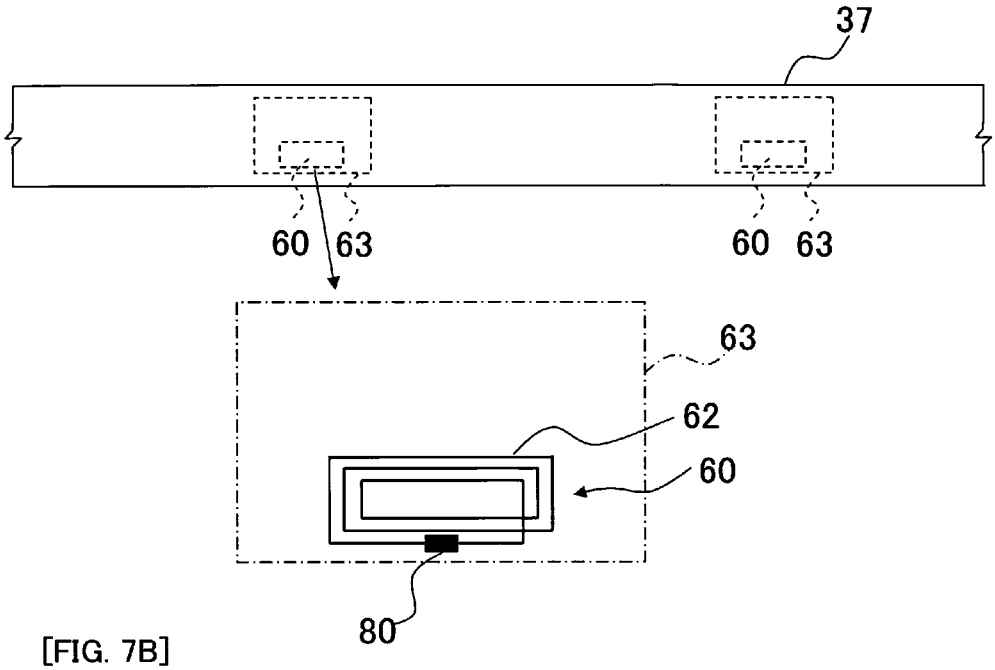
[FIG. 7B]
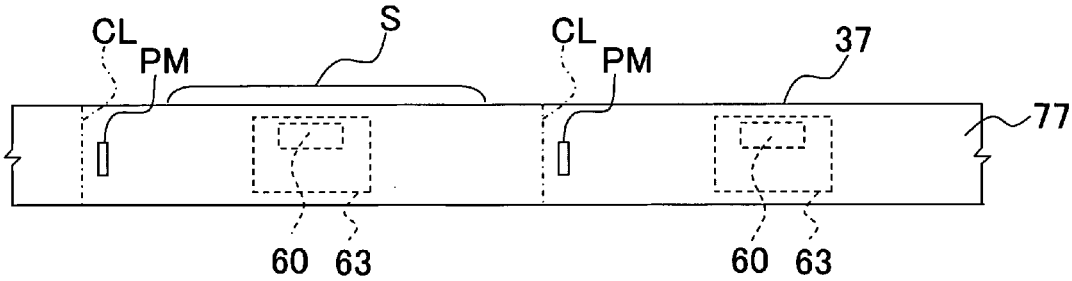
[FIG. 7C]
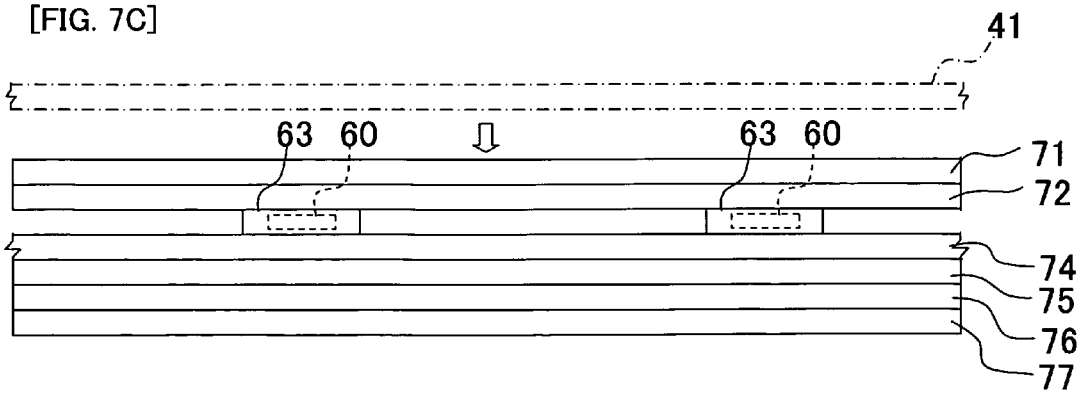

[FIG. 8A]
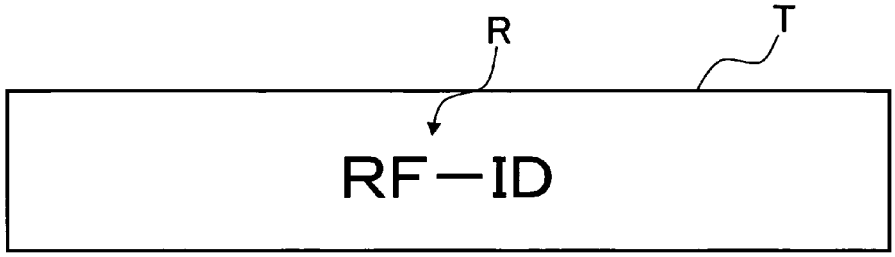
[FIG. 8B]
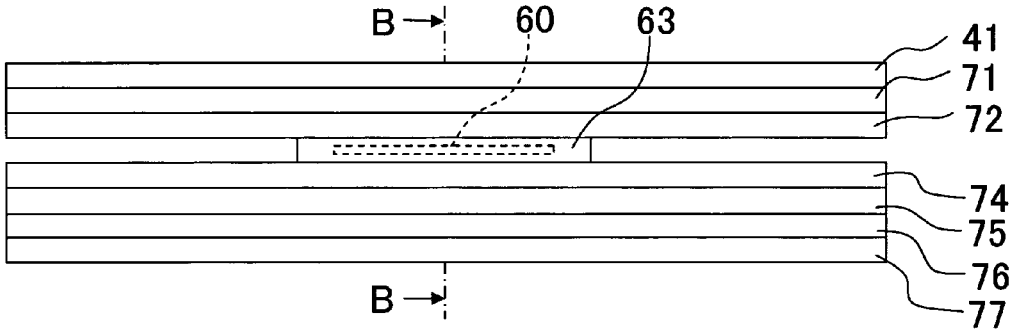
[FIG. 8C]
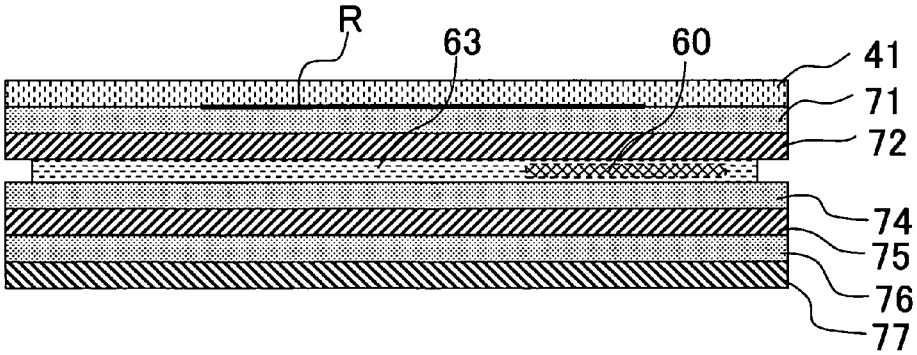

[FIG. 9]

RFID LABEL TYPE 13.56MHz, 100mm × 36mm TAG

PRINT CHARACTERS

RF−ID

ACCESS ID 1 6 , 7 7 7 , 2 1 5

ARTICLE INFORMATION 1 3 1 , 0 7 1

SERVER INFORMATION

2 , 0 9 7 , 1 5 1

[FIG. 10A]
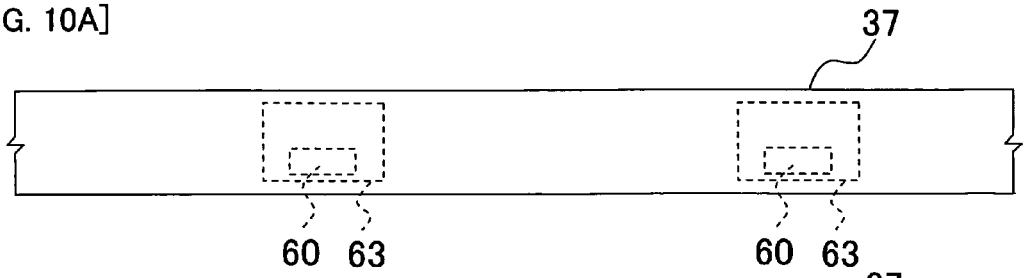
[FIG. 10B]
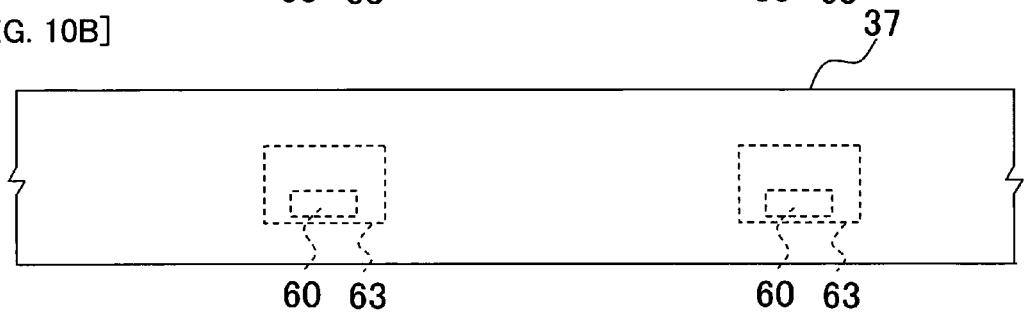
[FIG. 11A]
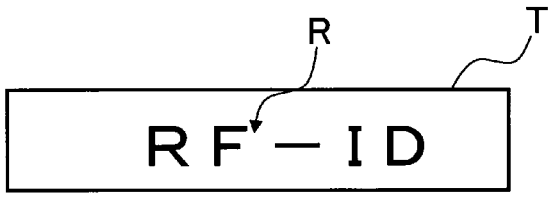
[FIG. 11B]
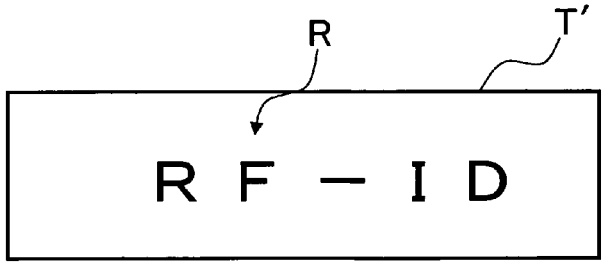
[FIG. 11C]
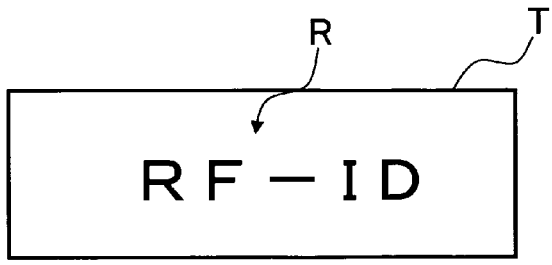

[FIG. 12]
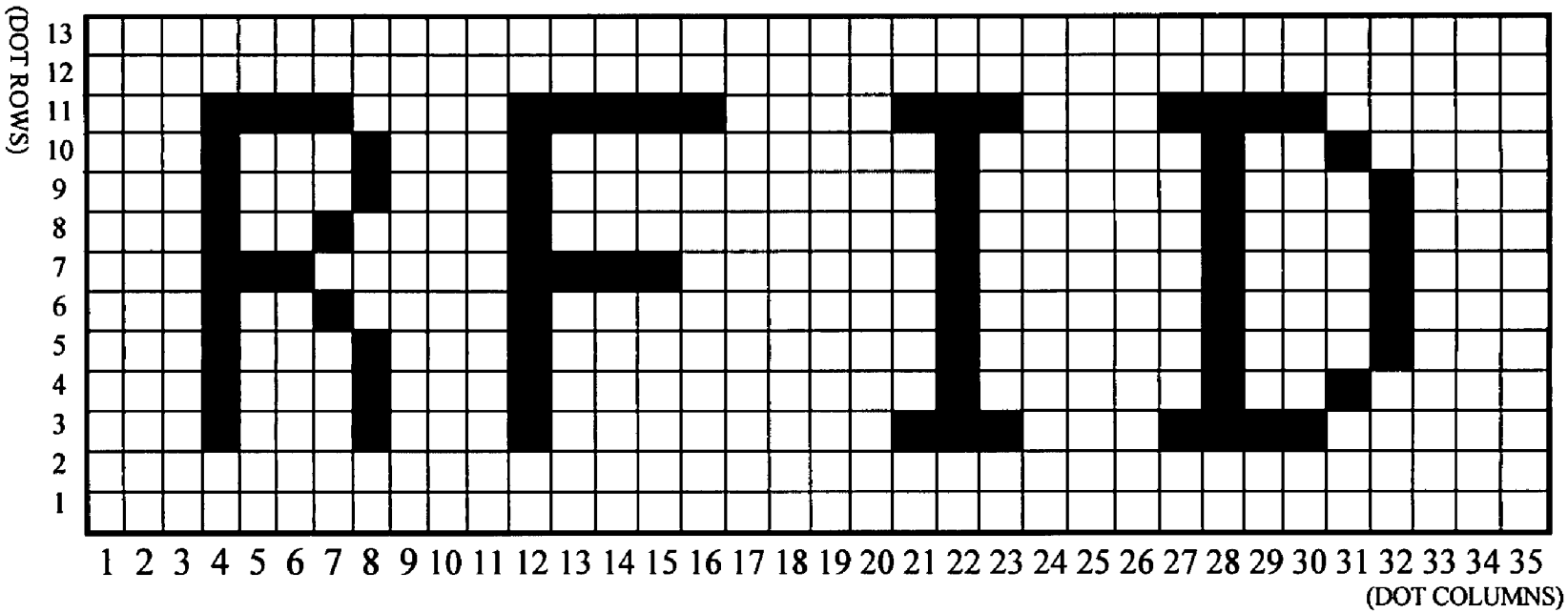

[FIG. 13A]
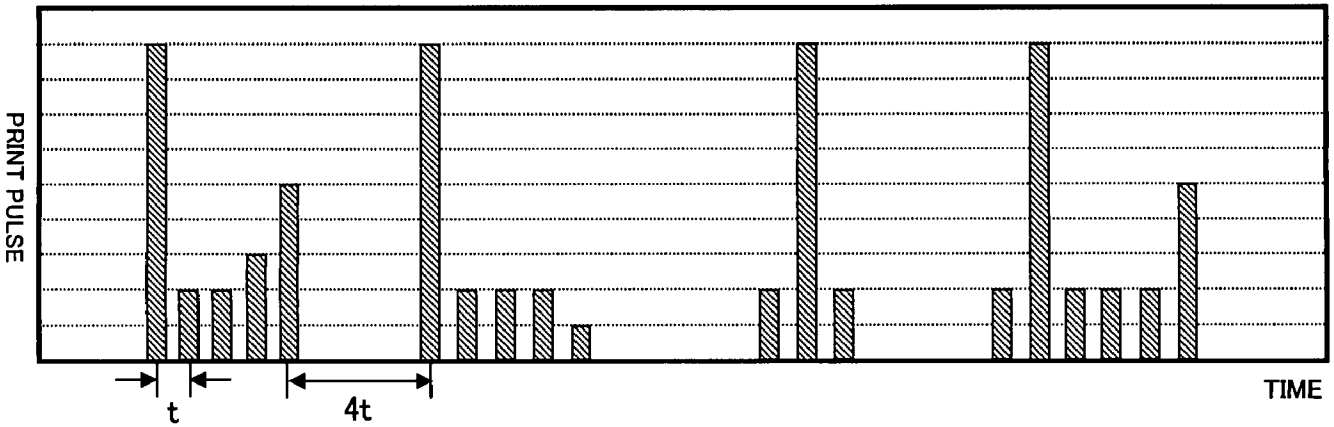
[FIG. 13B]
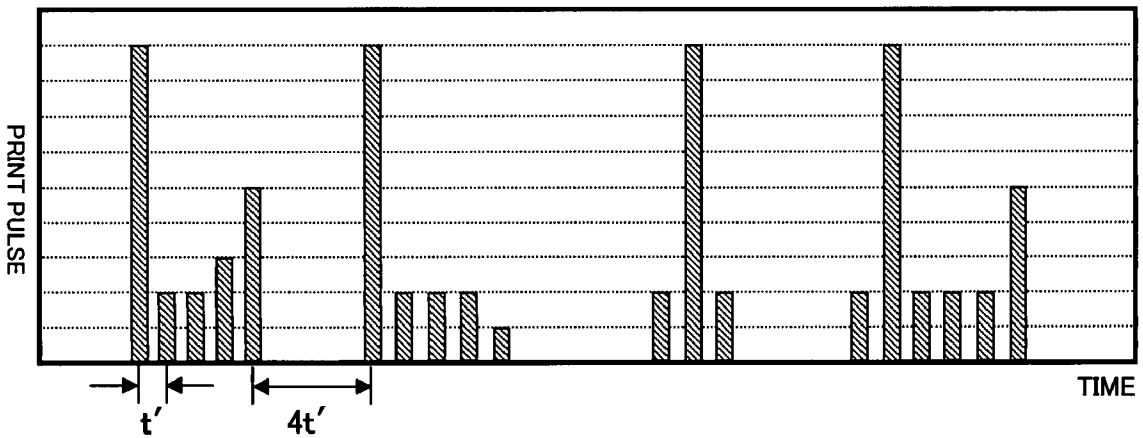

[FIG. 14A]

| TAPE WIDTH | PRINT PULSE INTERVAL |
|---|---|
| NARROW | LARGE |
| WIDE | SMALL |

[FIG. 14B]

| TAPE WIDTH | ROLLER RPM |
|---|---|
| NARROW | HIGH |
| WIDE | LOW |

[FIG. 15A]

| TAPE THICKNESS | PRINT PULSE INTERVAL |
|---|---|
| THIN | LARGE |
| THICK | SMALL |

[FIG. 15B]

| TAPE THICKNESS | ROLLER RPM |
|---|---|
| THIN | HIGH |
| THICK | LOW |

[FIG. 16A]

| PULL-OUT FORCE | PRINT PULSE INTERVAL |
|---|---|
| LARGE | LARGE |
| SMALL | SMALL |

[FIG. 16B]

| PULL-OUT FORCE | ROLLER RPM |
|---|---|
| LARGE | HIGH |
| SMALL | LOW |

[FIG. 17A]

| FRICTIONAL COEFFICIENT | PRINT PULSE INTERVAL |
|---|---|
| HIGH | SMALL |
| LOW | LARGE |

[FIG. 17B]

| FRICTIONAL COEFFICIENT | ROLLER RPM |
|---|---|
| HIGH | LOW |
| LOW | HIGH |

PRINTING APPARATUS CONTAINING A HARMONIZATION CHANGING PORTION WHICH CHANGES FEEDING SPEED BASED ON PROPERTIES OF THE PRINT RECEIVING MEDIUM

CROSS-REFERENCE TO RELATED APPLICATIONS

This application claims priority from JP 2007-202242, filed Aug. 2, 2007, the contents of which are hereby incorporated by reference.

BACKGROUND

1. Field

The present disclosure relates to a printing apparatus that prints on a print-receiving medium.

2. Description of the Related Art

As an example of a printing apparatus according to a prior art, a printing apparatus (label producing apparatus) has been proposed in which a tape that acts as a print-receiving material is stored within a cartridge in the form of a roll and desired characters are print while the tape is fed out from the roll in label-shape. (Refer to JP, A, 2006-309557 for example).

This prior art comprises a roll around which a base tape (double-sided adhesive tape), which is provided with a separation sheet, is wound, and a roll around which a print-receiving tape (film tape) to be bonded to this base tape is wound. The base tape and the print-receiving tape are respectively fed out from these two rolls driven by the driving force of a feeding roller (pressure roller) while a desired print is printed on the print-receiving tape by a printing means. The printed print-receiving tape and the base tape are then bonded to each other so as to form a label tape with print. This label tape with print is then cut by a cutter, thereby producing a label with print (printed label).

In response to the increase in use of printed labels in recent years, there has been a desire for varied uses, generating needs for producing many types of printed labels whose properties are modified in many ways. For example, a desire has arisen for printed labels with properties corresponding to these needs, by using many different types of layer structures for the tape used in labels, using tapes with differing widths and thicknesses, and so on. With the above prior art it is possible to respond to needs for variations in layer structure therein, and it is possible not only to produce printed labels using tape in which a base tape is bonded to a label with print after printing (and whose thickness dimension becomes relatively thicker), but also printed labels using only tape with print after performing desired printing (and whose thickness dimension is relatively thinner).

However, with the constitution described above in which tape feed is performed using a feeding roller, there is a possibility of a difference in feeding speeds arising if, for example, the thicknesses of the tapes differ, since a difference will arise in the distance from the center of the roller to the outer diameter of the tape, in terms of the circumference of the feeding roller. In other words, even if the feeding roller is rotating at the same rotational speed, a larger tape thickness might cause the tape feeding speed to become relatively faster, since the distance from the center of the roller to the tape outer circumference surface will grow, while if the thickness of the tape is small, the tape feeding speed might become relatively slower since the distance from the center of the roller to the tape outer circumference surface will be smaller.

If such variation in feeding speeds occurs, a variation in the balance with the print forming process by the printing means will also occur, creating the risk that printing in the property intended by the operator cannot be done reliably. In other words, the above example entails a risk of the interval between characters in the printer label actually produced being larger than the property of printing intended by the operator, since a faster feeding speed will cause feeding to advance faster than intended in terms of the relationship between feeding and the print forming process. In contrast, if the feeding speed is slower, then feeding will lag more than intended in terms of the relationship between feeding and the print forming process, creating the risk that the interval between characters will be more narrowly cramped in the printed labels actually produced than in the property of printing intended by the operator.

Note that the size of the tape thickness was given as an example above, but other causes can also be imagined which might affect the feeding speed and cause a similar problem, such as the material of the tape, the type, the size of the pull-out force, the size of the frictional coefficient, and so on. Further, the presence of antennas, etc., has also affected feeding speed in the production of RFID labels with print that are provided with antennas or IC circuit parts, when this is applied to RFID systems that read/write information in a non-contact manner between the compact wireless tags and the readers (reading apparatus)/writers (writing apparatus) whose practical application has advanced in recent years.

SUMMARY

The object of the present disclosure is to provide a printing apparatus capable of maintaining a good balance between feeding speed and the print forming process and executing printing reliably in the property intended by the operator.

To achieve this object, an aspect of the present application comprises feeding device that applies a driving force to feed a print-receiving medium, a print forming device that performs a print forming process on the print-receiving medium fed by the driving force of the feeding device, a harmonization controlling portion that harmonizes and controlling a driving speed of the feeding device and the print forming process operation of the print forming device, based on an input of print information according to an operation of an operator by using a predetermined harmonization correlation, and a harmonization changing portion that changes the harmonization correlation according to properties of the print-receiving medium or a bonding medium to be bonded to the print-receiving medium.

In the aspect of the present disclosure, print is formed on the print-receiving medium according to print information input by the harmonization controlling portion. When this happens, the harmonization changing portion changes the harmonization correlation between the driving speed and the print forming process operation based on the properties of the print-receiving medium (or the bonding medium to be bonded thereto). Thus if the feeding lags relatively in terms of the relationship between the feeding and the print forming process, such as, for example, when the print-receiving medium is a tape and in cases where the pull-out force is large, the frictional force between the tape and the feeding roller is small, the tape thickness dimension is small, the tape width dimension is small and the frictional load in a print forming part is large, and so on, the driving speed (e.g., the roller rotation speed) of the feeding device can be made faster, thus making longer the output interval of a signal element (e.g., a pulse) of a print instruction signal that instructs the print forming process of the print forming device. In contrast, if the feeding advances relatively in terms of the relationship between the feeding and the print forming process, such as, for example, when the print-receiving medium is a tape and in cases where the pull-out force is small, the frictional force between the tape and the feeding roller is large, the tape thickness dimension is large, the tape width dimension is small and the frictional load in a print forming part is small, and so on, the driving speed of the feeding device can be made slower, thus making shorter the output interval of a signal element of a print instruction signal that instructs the print forming process of the print forming device. It is thus possible to maintain a good balance between feeding and the print forming process and reliably execute printing in the aspect intended by the operator.

BRIEF DESCRIPTION OF THE DRAWINGS

FIG. 1 is a view showing a constitution of an RFID label manufacturing system in which a tag label producing apparatus according to one embodiment of the present disclosure can be used.

FIG. 2 is an oblique perspective view showing an external constitution of a tag label producing apparatus.

FIG. 3 is a view showing a schematic model of a constitution of main parts of an internal unit provided inside the apparatus body.

FIG. 4 is a functional block diagram showing a functional constitution example of an RFID circuit element.

FIG. 5 is a functional block diagram illustrating a functional constitution example of a control system of the tag label producing apparatus.

FIG. 6 is a flowchart showing a procedure of main processes in a tag label producing process.

FIG. 7A is a top view showing an example of a constitution of the base tape in the tape lengthwise and tape width directions, FIG. 7B is bottom view thereof, and FIG. 7C is a view showing a constitution in the tape thickness direction from a lateral side thereof.

FIG. 8A is a top view illustrating an example of the configuration of the RFID label produced from the base tape, FIG. 8B is a lateral view from the side surface side, and FIG. 8C is a cross-sectional view of the B-B cross-section in FIG. 8B.

FIG. 9 is a view showing a display example of the terminal device during production of the RFID labels.

FIG. 10A is a top view showing one example of a constitution of the base tape in a tape lengthwise direction, and is equivalent to FIG. 7A. FIG. 10B is a top view showing the constitution of the base tape in the tape lengthwise direction in a case in which the tape width direction dimension is wider than in FIG. 10A.

FIGS. 11A, 11B, 11C are views showing examples of produced RFID labels.

FIG. 12 is a view showing a conceptual example of dot pattern data stored in the print buffer when processing print data in the print buffer (in this example, the characters "RFID" in accordance with an example of the case in which the RRID label in FIG. 11A is produced).

FIG. 13A is a view showing a conceptual example of pulse behavior of a print instruction signal output to the print head from the print head driving circuit when printing the characters "RFID" of FIG. 12A using the print head. FIG. 13B is a view showing a conceptual example of pulse behavior when shortening the pulse output interval for instructing the print head to perform the print forming process, as an example of changing the harmonization correlation for printing the characters "RFID" in FIG. 11C with the print head.

FIGS. 14A and 14B are respectively concise summary of changes to the harmonization correlation.

FIG. 15 is a view showing an example of changing a harmonization correlation.

FIG. 16 is a view showing an example of changing a harmonization correlation.

FIG. 17 is a view showing an example of changing a harmonization correlation.

DETAILED DESCRIPTION OF THE PREFERRED EMBODIMENTS

An embodiment of the present disclosure is described below with reference to the drawings. Note that while the present embodiment is an embodiment of a case in which the present disclosure is applied to a label producing apparatus, this is not a limitation, and the present disclosure may be applied to other printing apparatus that print on a print-receiving medium.

In an RFID label system TS shown in FIG. 1, a tag label producing apparatus 1 is connected to a root server RS, an information server IS, a terminal device DTa, a general purpose computer DTb, and so on, via a communication network NW made up of appropriate communication lines and so on.

The tag label producing apparatus 1, as shown in FIG. 2, comprises an apparatus main body 2, and a cartridge 3 loaded on a cartridge holder 31 (refer to FIG. 3 discussed below).

The apparatus main body 2 (comprising a top face part, a bottom face part, a front face part, a rear face part, and left and right side face parts) is provided with an overall rectangular cubical housing 2*s* as an outer shell. A top lid 4 and a top lid manipulating button 5 are provided to the top face part. On the front face part are provided a label discharge opening 7, a front lid 8, a power button 9, and a cutter driving button 10.

The top lid 4 is rotatably supported at the end part of the right back side in FIG. 2 of the apparatus main body 2, is biased in an opening direction by a biasing member (not shown), and is lockable to the apparatus main body 2. When the cartridge 3 is loaded or removed, the lock is released by pressing the top lid manipulating button 5, the top lid 4 then opens due to the biasing action of the biasing member, and the cartridge 3 is subsequently loaded or removed in that state. Furthermore, an inspection window 15 fit in such as a transparent cover is provided to the top lid 4.

The label discharge opening 7 discharges to the exterior RFID labels T produced inside the apparatus body 2. The front lid 8 can be opened and closed by being rotated around a bottom edge, and rotates open in a forward direction by pushing up on a pushing part 8*p* provided to a top edge. The power button 9 is used to turn on and off the main power source of the tag label producing apparatus 1. The cutter driving button 10 is for making a length of an RFID label T a desired length, when the operator manually operates a cutter 51, described below (see FIG. 3).

As shown in FIG. 3, the internal unit 31 comprises a cartridge holder 31, and the cartridge 3 of FIG. 2 is loaded and removed into and from this cartridge holder 31.

The internal unit 30 comprises a tape feeding roller driving shaft 46*a* that drives the tape feeding roller 46, a ribbon take-up roller driving shaft 45*a* that drives the ribbon take-up roller 45, a sub-roller 47, a print head 49, a platen roller 50, a cutter 51, an antenna 52, and a discharging roller 53. Note that a mark sensor 103 (will be discussed in greater detail below) is provided between the cutter 51 and the antenna 52 (in a central part in the tape feeding direction).

The cartridge 3 has a base tape roll 36 (actually in a spiral shape, but simplified and shown as concentric circles), a cover film roll 39 (actually in a spiral shape, but simplified and shown as concentric circles), the feeding roller 46, and the ribbon take-up roller 45. The base tape roll 36 is a wound roll of the base tape 37, which is a bonding medium, wound around a tag tape reel part 38. The cover film roll 39 is a transparent cover film 41 made of, for example, PET (polyethylene terephthalate) resin, wound around a cover film reel part 42 and made into a roll. The cartridge 3 is provided with an ink ribbon roll 43, and a ribbon take-up roller 45 (driven by the ribbon take-up roller driving shaft 45*a*) that takes up an ink ribbon 44 fed out from the ink ribbon roller 43. The ribbon take-up roller driving shaft 45*a* is driven and controlled by a roller driving circuit which is not shown.

The cartridge holder 31 is constituted such that a plurality of cartridges 3 of mutually differing types can be loaded and removed. The cartridges 3 differ by type in, for example, the width direction dimension and the thickness direction dimension, the type, the material, the size of the pull-out force, the size of the frictional coefficient, and so on of the base tape 37 or the cover film 41. Cartridges in which an RFID circuit element 60 (will be discussed below) is not provided to the base tape 37 can also be loaded and removed.

A cartridge sensor 102 capable of detecting the type of the cartridge 3 by detecting a detected part 190 of the cartridge 3 is provided to a corresponding position on the cartridge holder 31. The detection signal from the cartridge sensor 102 is input to a controller 90 (see FIG. 5 discussed below), thereby detecting the type of the cartridge 3 described above, or in other words, the width direction dimension and the thickness direction dimension, the type, the material, the size of the pull-out force, the size of the frictional coefficient, and other tape properties of the base tape 37 or the cover film 41 in the cartridge 3.

A part of the cartridge 3 is visible from the outside through the above-described inspection window 15, when loaded to the cartridge holder 31. Specifically, on the front face of the cartridge 3 is provided, for example, a tape type display part (not shown) that displays the tape type, such as the tape width and color, of the base tape 37. This tape type display part is visible from the outside through the inspection window 15 with the cartridge 3 loaded to the cartridge holder 31.

The feeding roller 46 and the sub-roller 47 are rotationally driven by the feeding roller 46 that is driven by the feeding roller driving shaft 46*a*. The feeding roller driving shaft 46*a* is driven and controlled by a roller driving circuit which is not shown. The base tape 37 fed out from the base tape roll 36 and the cover film 41 fed out from the cover film roll 39 are bonded by being pressed and sandwiched between the feeding roller 46 and the sub-roller 47 in a stacked state. The feeding roller 46 and the sub-roller 47 perform a bonding function as well as a function of carrying and feeding in the direction A a tag label tape 48 with print which is a tag medium formed by bonding the base tape 37 and the cover film 41. Note that when performing this bonding, the feeding roller 46 carries the base tape 37 and bonds the base tape 37 and the cover film 41 while touching a circumferential length of at least ¼ or more of the total outer circumference of the base tape 37 (in other words, rotating 90° or more in the advancing direction of the base tape 37) in this example, as shown in FIG. 3.

In this example, the print head is a thermal head comprising a plurality of heat-emitting elements. The platen roller 50 is provided to a position opposite the print head 49. As the cover film 41 fed out from the cover film roll 39 passes between the print head 49 and the platen roller 50, the heat-emitting elements are driven by a print instruction signal (including pulses as signal elements; discussed in greater detail below) from a print head driving circuit which is not shown. When this happens, the roller driving speed (roller rpm) by the feeding roller driving shaft 46*a* and the pulse signal to the print head 49 are controlled so as to harmonize based on a predetermined correlation which is set in advance (discussed in detail below), thereby forming print characters, print images, and the like intended by the operator on the cover film 41 (in this example, from the top of FIG. 3, which is the reverse side thereof).

The cutter 51 is connected to a solenoid which is not shown, and cuts the tag label tape 48 with print to a predetermined length, thus forming the RFID label T by the solenoid that is excited by a solenoid driving circuit (not shown).

The antenna 52 performs communication in order to read or write information with respect to the RFID circuit elements 60 (discussed in greater detail below) disposed on the base tape 37 (after bonding, the tag label tape 48 with print; same hereafter).

The discharging roller 53 is rotationally driven by being driven by a discharging roller driving shaft which is not shown. Note that the discharging roller driving shaft is controlled by a discharging roller driving circuit which is not shown (and may be the same as the feeding roller driving circuit described above).

As shown in FIG. 4, the RFID circuit element 60 comprises the IC circuit part 80 and the tag antenna 62 connected thereto.

The IC circuit part 80 comprises a rectification part 81 that rectifies the interrogation waves received via the tag antenna 62, a power source part 82 that stores the energy of the interrogation waves rectified by the rectification part 81, and serves as a driving power supply, a clock extraction part 84 that extracts clock signals from the interrogation waves received by the tag antenna 62 and supplies the clock signals thus extracted to a control part 83, a memory part 86 capable of storing predetermined information signals, a modem part 85 connected to the tag antenna 62, and the control part 83 that controls the operation of the RFID circuit element 60 via the memory part 86, the clock extraction part 84, the modem part 85, and so on.

The modem part 85 demodulates communication signals from the tag label producing apparatus 1 received by the tag antenna 62, modulates a response signal from the control part 83, and re-sends this as a response with the tag antenna 62.

The control part 83 executes basic control, such as interpreting a received signal demodulated by the modem part 85, generating a response signal based on the information signal stored in the memory part 86, and returning the response signal from the modem part 85.

The clock extraction part 84 extracts the clock component from the received signal and extracts the clock to the control part 83, supplying the clock corresponding to the frequency of the clock component of the received signal to the control part 83.

A control system of the tag label producing apparatus 1 is shown in FIG. 5. In FIG. 5, the tag label producing apparatus 1 is provided with a control part 90 comprising a microprocessor, etc., for example.

The control part 90 comprises a CPU 91, a main storage device 92 and an auxiliary storage device 93.

The auxiliary storage device 93 comprises a tag label production program 94 which is a program for the tag label production function, a tag label production storing part 96 that stores basic data for producing RFID labels (such as print font, graphics patterns for printing, and so on), a tag label production instruction data storing part 97 that stores instruction data associated with tag label production input by the terminal device DTa, and a harmonization correlation storing part 98 in which is stored a predetermined harmonization correlation (discussed in detail below) that causes the driving speed (roller rpm) of the feeding roller driving shaft 46*a* and the print forming process operation of the print head 49 to operate in harmony. The tag label production instruction data storing part 97 comprises a print buffer 97A that stores as dot pattern data dot patterns for printing corresponding to print information such as print content, or an applied pulse number, which is the formation energy amount for each dot (see FIG. 12 discussed below for greater detail). The print head 49 performs dot printing according to the dot pattern data stored in this print buffer 97A. Note that the control part 90 is connected, via an input/output interface 109, to the communications network NW to which the terminal device DTa and general purpose computer DTb described above are connected.

The CPU 91 comprises a harmonization control part 95 and a harmonization changing part 99. The harmonization control part 95 harmonizes and controls the driving speed (roller rpm) of the feeding roller driving shaft 46*a* via the feeding roller driving circuit and the print forming process operation of the print head 49 via the print head driving circuit, using a harmonization correlation stored in the harmonization correlation storing part 98 based on the input instruction data (print information). The harmonization changing part 99 changes the harmonization correlation according to the detection results of the cartridge sensor 102.

The input/output interface 109 is connected to driving systems such as a tape feeding system 106 including the feeding roller driving circuit in the internal unit 30, a label feeding system 107 including the discharging roller driving circuit, a print driving system 105 including the print head driving circuit, a cutter driving system including the solenoid driving circuit, and a transmission/reception circuit 108 connected to the mark sensor 103, the cartridge sensor 102, and the antenna 52 (may be at least partially shared, or may be independent units).

In the tag label producing apparatus 1, when, for example, the input for tag label production is made by the terminal apparatus DTa, an instruction signal corresponding thereto is input into the control part 90 via the input/output interface 109, and various controls for executing tag label production are executed by the control part 90. In order to carry out the above controls, the control procedure shown in FIG. 6 is executed by the control part 90.

In FIG. 6, first in step S110, the CPU 91 gets tape property information detected using a detection signal from the cartridge sensor 102 (e.g., the width direction dimension and the thickness direction dimension, the type, the material, the size of the pull-out force, the size of the frictional coefficient, and so on of the base tape 37 or the cover film 41 in the cartridge 3).

Thereafter, in step S120, the harmonization changing part 99 of the CPU 91 appropriately corrects and changes the harmonization correlation (in this example a correlation between the roller rpm by the feeding roller driving shaft 46*a* and the print instruction signal to the print head 49) set and held in advance in the harmonization correlation storing part 98 based on the tape property information gotten in step S110.

This change is done based on a comparison of the properties envisioned of the base tape 37 and the cover film 41 provided in the cartridge 3 and properties envisioned as a reference of the harmonization correlation. For example, if the tape width direction dimension of the base tape 37 or the cover film 41 is smaller than the reference value, the feeding will lag relatively in terms of the relationship between the feeding and the print forming process, since the area of direct contact between the print head 49 and the platen roller 50 will increase, and the tape moving resistance during feeding will grow due to an increase in the frictional power between the two. The harmonization correlation is changed so as to lengthen the output interval of the pulses of the print instruction signal that instructs the print head 49 to perform a print forming process (or so as to speed up the roller rpm by the feeding roller driving shaft 46*a*). The harmonization correlation is similarly changed in a case in which the tape thickness dimension of the base tape 47 or the cover film 41 is smaller than the reference value (since the tape feed speed increases as the distance from the center of the roller to the surface of the tape outer circumference the larger the thickness dimension is, even with the same roller rpm), in cases of tape materials or tape types in which the pull-out force is larger than the reference value (since the tape moving resistance similarly increases), in cases of tape materials or tape types in which the frictional force is smaller than the reference value (since slipping will occur between the roller and the tape), or in other cases in which the feeding lags relatively.

In contrast, if for example, the tape width dimension of the base tape 37 or the cover film 41 is larger than the reference value, the feed advances relatively in terms of the relationship between the feed and the print forming process, since the tape moving resistance is smaller during feeding. The harmonization correlation is changed so as to shorten the output interval of the pulses of the print instruction signal that instructs the print head 49 to perform a print forming process (or so as to slow down the roller rpm by the feeding roller driving shaft 46*a*). The harmonization correlation is similarly changed in a case in which the tape thickness dimension of the base tape 37 or the cover film 41 is larger than the reference value, in cases of tape materials or tape types in which the pull-out force is smaller than the reference value, in cases of tape materials or tape types in which the frictional force is larger than the reference value, in a case of a tape provided with the RFID circuit elements 60 (because if the harmonization correlation is set using a tape not provided with the RFID circuit elements 60 as a reference, the thickness direction dimension increases, thus increasing the feeding speed), or in other cases in which the feed advances relatively.

Note that it is also possible not to decide whether or not to change the harmonization correlation by comparing one tape property with a corresponding reference value (and deciding the degree of change if a decision is made to make a change), but rather to decide whether or not to change the harmonization correlation by comprehensively taking into consideration a plurality of combinations of the tape properties.

Thereafter, in step S130, the harmonization control part 95 of the CPU 91 outputs a control signal to the feeding driving system 106 via the input/output interface 109 based on the harmonization correlation thus changed, and the feeding roller 46 is driven. The base tape 37 is thus fed out from the base tape roll 36 and the cover film 41 is also fed out from the cover film roll 39 in sync with the feeding out of the base tape 37. The tag label tape 48 with print is thus formed by the feeding roller 46 and the sub-roller 47, and feeding of the tag label tape 48 with print in the direction of the arrow A is initiated by the feeding roller 46. Thereafter in step S140, the harmonization control part 95 of the CPU 91 outputs a control signal to the print driving system 105 via the input/output interface 109 based on the harmonization correlation thus changed. The ribbon take-up roller 45 is thus driven and the ink ribbon 44 is fed out from the ink ribbon roll 43, and the print head 49 is driven by a print instruction signal (including pulses) from the print driving system 105. As a result, the cover film 41 fed out form the cover film roll 39 is printed on by the print head 49 before being bonded to the base tape 37 by the feeding roller 46 and the sub-roller 47. The cover film 41 which has been printed on is bonded to the base tape 37 by the feeding roller 46 and the sub-roller 48 for which driving has already been initiated in step S101.

The tag label tape 48 with print, in which the base tape 37 and the cover film 41 have been bonded is fed in the direction of the arrow A by the feeding roller 46 and reaches a position near the antenna 52 (an opposing position). Once the RFID circuit element 60 in the tag label tape 48 with print reaches a feeding position so as to essentially oppose the antenna 52 (or reaches the vicinity so as to enter the communication range), the process moves to step S150. In step S150, the CPU 91 outputs a control signal to the feeding driving system 106 via the input/output interface 109, and the feeding of the tag label tape 48 with print stops. Further, the CPU 91 outputs a control signal to the transmission/reception circuit 108 via the input/output interface 109 and communication for reading or writing information (information transmission/reception) as described above is executed via the antenna 52. When information is written, corresponding information based on, for example, the data entered using the terminal apparatus DTa of FIG. 1 is written and when information is read, the read information is displayed on the terminal apparatus DTa, for example.

When reading or writing of information by the antenna 52 is finished, the CPU 91 outputs a control signal to the feeding driving system 106 via the input/output interface 109 to restart feeding of the tag label tape 48 with print, and then once the RFID circuit element 60 has advanced a predetermined distance, in step S160 the CPU 91 outputs a control signal to the feeding driving system 106 via the input/output interface 109 to once again stop feeding of the tag label tape 48 with print. The CPU 91 outputs a control signal to the cutter driving system 104 via the input/output interface 109 to cut the tag label tape 48 with print by operating the cutter 51, and an RFID label T of the predetermined length is thus obtained.

Once the RFID label T of the predetermined length is obtained by the cutting operation in step S160, in step S170 the CPU 91 outputs a control signal to the label feeding driving system 107 via the input/output interface 109 to discharge the RFID label T to the exterior with the discharging roller 53. The tag label producing process thus finishes for one RFID label T.

As shown in FIGS. 7A, 7B, and 7C, a plurality of RFID circuit elements 60 are arranged at predetermined intervals in the lengthwise direction (in this example, embedded). The RFID circuit elements 60 comprise an IC circuit part 80 and a tag antenna as described above, and in this example are totally covered by a protective member 63 formed as a sheet from an appropriate synthetic resin material.

The base tape 37 has a 7-layer structure having an adhesive layer 71, a tape base layer 72, an adhesive layer 74, a covered RFID circuit element 60, a tape base layer 75, an adhesive layer 76, and a separation sheet 77, in this order, from the surface side (the top in FIG. 7) towards the opposite side.

The adhesive layer 71 is an adhesive layer that bonds the cover film, and functions to bond the cover film 41 to the base tape 37 as described above. The tape base layer 72 and the tape base layer 75 are formed in a substantially tape-like shape made of, for example, PET or another resin material. In this example, the RFID circuit elements 60 (covered by the protective member 63) are disposed between the tape base layers 72 and 75 by the adhesive layer 74 provided to the tape base layer 75. Note that an adhesive layer for fixing may also be provided to the tape base layer 72. The adhesive layer 76 is used for attaching the RFID label T to target merchandise, etc.

The separation sheet 77 functions for protection until attachment to the first adhesive layer 76, and is provided with identification marks PM associated with the positions of the RFID circuit elements 60 (in other words, at a predetermined equal interval). The identification marks PM are used to control feeding (positioning control) (for print control, communication control, and cutting control) of the base tape 37, the cover film 41, and the tag label tape 48 with print by being detected by the mark sensor 103.

In other words, during print control in step S140 after initiation of tape feeding in step S130 in FIG. 6, for example, printing is initiated to the cover film 44 by the print head 49 when an identification mark PM is first detected when starting tag label production using the feeding position as a reference. (Thus, for example, a predetermined range of the cover film 44 corresponding to a position backwards in the feeding direction of the identification mark PM is in a printing area S. See FIG. 7B.) In step S150, feeding by the feeding roller 46 is stopped after feeding a predetermined amount from the print start position, and transmission/reception of information is done using wireless communication to and from the RFID circuit element 60 for label production using the antenna 52 (communication may be initiated without stopping the feeding or while feeding in a decelerated state). Thereafter, in step S160, feeding by the feeding roller 46 is stopped after feeding a predetermined amount from the communication position (communication start position), the tag label tape with print is cut at a cutting position CL by the cutter 51 (see FIG. 7B), and the leading edge side is fed as the RFID label T from the cutting position CL (step S170).

As shown in FIGS. 8A-8C, as described above, the RFID label T is formed by cutting to a predetermined length or a desired length the tag label tape 48 with print (see FIG. 3, etc.) in which the cover film 41 is bonded to the base tape 37 with the 7-layer structure described above. As a result, by adding the cover film layer 41 by the cover film 41 to the 7-layer structure described above in the base tape 37, the structure becomes an 8-layer structure having the cover film layer 41, the adhesive layer 71, the tape base layer 72, the covered RFID circuit element 60, the adhesive layer 74, the tape base layer 75, the adhesive layer 76, and the separation sheet 77, in the same order as above, with print characters R printed on the cover film layer 41 from the rear side, as described above.

An example of a display in a display screen of the terminal device DTa during production of the RFID labels T is shown in FIG. 9. In this example, the type of the RFID label T (access frequency and tag label dimensions), print characters printed by the print head 49, an access ID which is identification information unique to the RFID circuit element in the RFID label, the address of article information stored in the information server of FIG. 1, and the storage address for corresponding information in the root server RS of FIG. 1 are included.

Here, as described above, in the present embodiment, the harmonization correlation that harmonizes and operates the feeding and print forming process is changed according to the tape property information of the cartridge 3. The following describes this in detail.

As described above, various types of cartridges 3 can be loaded into the cartridge holder 31. When the cartridge 3 provided with the base tape 37 with the width shown in FIG. 10B is loaded and the tape is fed, the tape moving resistance is lower for the reasons described above than when loading the base tape 37 shown in FIG. 10A and feeding the tape. As a result, even if a drive signal is output to the feeding roller driving shaft 46*a* from the feeding driving system 106 in order to achieve the same rpm (without specifically changing the roller rpm), the difference in tape moving resistances will cause the feeding speed of the base tape 37 with the width of FIG. 10B to be faster in actuality (i.e., the feeding will relatively advance in terms of the relationship between the feeding and the print forming process).

Accordingly, even if the RFID labels were produced using the base tape 37 of FIG. 10A and the base tape 37 of FIG. 10B with the same (unchanged) harmonization correlation between the feeding and the print forming process as described above, there is the possibility that RFID labels with different properties might result. In other words, for example in a case in which the base tape 37 of FIG. 10A is used, an RFID label T of the desired length as intended by the operator is produced as shown in FIG. 11A. In contrast, however, if the base tape 37 of FIG. 10B is used, the print character interval will expand in the tape lengthwise direction as the print area length grows in the tape length direction, as shown in FIG. 11B, to a degree equivalent to the amount of lag in feeding with respect to the original tape in FIG. 11A (corresponding to the feeding advancing). The result is RFID label T' with a property in which the total length of the label is longer and the print balance is bad.

In order to prevent this kind of negative effect with the present embodiment, for example when using the base tape 37 with the width shown in FIG. 10B, the harmonization correlation is changed such that the output interval of pulses of the print instruction signal that instructs the print head 49 to perform the print forming process is shorter (or such that the roller rpm by the feeding roller driving shaft 46*a* is slower), compared to the case in which the base tape 37 of FIG. 10A is used. The print character interval thus becomes narrower in the tape lengthwise direction as the print area length is reduced in the tape lengthwise direction comparing with the case of FIG. 11B, as shown in FIG. 11C, thus making it possible to produce the RFID label T with a property according to the original intention in terms of the total label length (an equivalent length to FIG. 11A) and with a favorable print balance (an equivalent balance to FIG. 11A).

A detailed description of changing the harmonization correlation is given below. A conceptual example of dot pattern data is shown in FIG. 12. Here, the figure shows an example in which the print data has been expanded into a 13-dot (row)×35-dot (column) buffer.

In FIG. 12, the character "R" is, for example, laid out in dot columns 4-8, and the total number of print dots in column 4 corresponding to the character "R" is 9, the total number of print dots in column 5 is 2, the total number of print dots in column 6 is 2, the total number of print dots in column 7 is 3, and the total number of print dots in column 8 is 5. Similarly, the character "F" is laid out in dot columns 12-16, and the total number of print dots in the column 12 corresponding to the character "F" is 9, the total number of print dots in columns 13-15 is 2, and the total number of print dots in column 16 is 1. Similarly, the character "I" is laid out in dot columns 21-23, and the total number of print dots in column 21 corresponding to the character "I" is 2, the total number of print dots in column 22 is 9, and the total number of print dots in column 23 is 2. Similarly, the character "D" is laid out in dot columns 27-32, and the total number of print dots in column 27 corresponding to the character "D" is 2, the total number of print dots in column 28 is 9, the total number of print dots in columns 29 and 30 is 2, the total number of print dots in columns 31 is 2, and the total number of print dots in column 33 is 5.

A conceptual example of pulse behavior of a print instruction signal output to the print head 49 from the print head driving circuit when printing the characters "RFID" of FIG. 12A using the print head 49 is shown in FIG. 13A. The horizontal axis is elapsed time, and the vertical axis shows the total number of pulses of the print instruction signal output to the print head 49 at the relevant timing. As shown in FIG. 13A, a number of pulses corresponding to the number of dots laid on the print buffer 97A described using FIG. 12 is output to the print head 49. In other words, when printing the character "R" laid out in dot columns 4-8 in this example, a number of pulses equivalent to 9 dots (column 4)→2 dots (column 5)→2 dots (column 6)→3 dots (column 7)→ and 5 dots (column 8) are output at each timing to the print head 49 from the print head driving circuit in the feeding direction. (Note that in actuality there is an on/off distribution of pulses with respect to the plurality of heat-emitting element columns arranged in tape width direction positions of the print head 49, but here only the total number of pulses is given, for simplicity's sake.) Here, the output interval between pulses is a predetermined value t set in the harmonization correlation in advance. (Accordingly, the pulse interval for the blank space between, for example, the "R" and the "F" is 4t.)

Similarly, when printing the character "F", a number of pulses equivalent to 9 dots (column 12)→2 dots (column 13)→2 dots (column 14)→2 dots (column 15)→ and 1 dot (column 16) are output at interval t with each timing to the print head 49 from the print head driving circuit in the feeding direction. (The pulse interval for the blank space between the "F" and the "I" is 5t.) When printing the character "I", a number of pulses equivalent to 2 dots (column 21)→9 dots (column 22)→ and 2 dots (column 23) are output at interval t with each timing to the print head 49 from the print head driving circuit in the feeding direction. (The pulse interval for the blank space between the "I" and the "D" is 4t.) When printing the character "D", a number of pulses equivalent to 2 dots (column 27)→9 dots (column 28)→2 dots (column 29)→2 dots (column 30)→2 dots (column 31)→ and 5 dots (column 32) are output at interval t with each timing to the print head 49 from the print head driving circuit in the feeding direction.

In contrast, a conceptual example of pulse behavior when shortening the pulse output interval for instructing the print head 49 to perform the print forming process is shown in FIG. 13B, as an example of changing the harmonization correlation for printing the characters "RFID" in FIG. 11C with the print head 49. In FIG. 13B, while the time-related behavior of the overall pulse output is the same as in FIG. 13A, the output interval between the pulses is now t', which is smaller than t in FIG. 13A. (For example, the pulse interval for the blank space between the characters "R" and "F" becomes 4t'.)

In FIGS. 10-13, an example was given of shortening the output interval of the pulses of the print instruction signal that instructs the print head 49 to perform the print forming process when using the base tape 37 with a large width direction dimension, but it is also possible to lengthen the pulse output interval when using the base tap 37 with a small width direction dimension. A concise summary of changes to the harmonization correlation is shown in FIG. 14A. Furthermore, instead of changes in the length of the pulse interval, it is also possible, as described above, to change the harmonization correlation to achieve balance by increasing or reducing the roller rpm by the feeding roller driving shaft 46*a* (without changing the print forming process). A concise summary of changes to the harmonization correlation is shown in FIG. 14B.

Changes to the harmonization correlation by changing the pulse output interval (or by increasing or decreasing the roller rpm) can be made in accordance with properties in addition to the size of the width direction dimension. As shown in FIG. 15A and FIG. 15B, the harmonization correlation is changed so as to increase the pulse output interval to the print head 49 (or to increase the roller rpm) when using a tape with a relatively small thickness direction dimension (the base tape 37 or the cover film 41; same hereafter), and is changed so as to decrease the pulse output interval to the print head 49 (or to decrease the roller rpm) when using a tape with a relatively large thickness direction dimension. In the examples of FIG. 16A and FIG. 16B, the harmonization correlation is changed so as to increase the pulse output interval to the print head 49 (or to increase the roller rpm) when using a tape with a relatively large pull-out force, and is changed so as to decrease the pulse output interval to the print head 49 (or to decrease the roller rpm) when using a tape with a relatively small pull-out force. In FIG. 17A and FIG. 17B, the harmonization correlation is changed so as to decrease the pulse output interval to the print head 49 (or to decrease the roller rpm) when using a tape with a relatively large frictional force, and is changed so as to increase the pulse output interval to the print head 49 (or to increase the roller rpm) when using a tape with a relatively small frictional force.

As described above, with the present embodiment, the harmonization changing part 99 provided to the control part 90 of the tag label producing apparatus 1 changes the harmonization correlation stored in the harmonization correlation storing part 98 in advance between the driving speed of the roller 46 and the print forming process operation of the print head 49, based on the tape properties of the base tap 37 and the cover film 41 using the detection results of the cartridge sensor 102. In a case in which the feeding relatively lags, such as in a case of a small tape width dimension, a small tape thickness dimension, a large tape pull-out force, or a small tape frictional force, the pulse interval to the print head 49 is made longer or the driving speed of the roller 46 is made faster. In contrast, in a case in which the feeding relatively advances, such as in a case of a large tape width dimension, a large tape thickness dimension, a small tape pull-out force, or a large tape frictional force, the pulse interval to the print head 49 is made shorter or the driving speed of the roller 46 is made slower. It is thus possible to maintain a good balance between feeding and the print forming process and reliably execute printing in the property intended by the operator.

Further, particularly with the present embodiment, the feeding roller 46 in this example feeds the base tape 37 by touching the base tape 37 with at least ¼ or more of its total outer circumferential length (or in other words, by rotating 90° or more in the advancing direction of the base tape 37). With this structure, changing the harmonization correlation has the following significance. Namely, in a case in which a tape such as the base tape 37 or the cover film 41 is fed using rollers, the more the tape is deflected by the roller (or in other words, the longer the time in contact with the tape), the larger the effect of the size of the tape thickness dimension, the frictional force, or the pull-out force on the feeding behavior. Accordingly, in a case in which the roller 46 feeds the base tape 37 by touching it with ¼ or more of its total circumference, the action of improving the balance between the feeding and the print forming process by changing the harmonization correlation with the harmonization changing part 99 is particularly effective.

Further, in the description above, an example of stopping the base tape 37, the cover film 41, or the tag label tape 48 with print while moving, and reading/writing and printing RFID tag information was given, but this is not a limitation. Namely, it is also possible to print and read/write while the base tape 37, etc., is still being fed (or decelerated). Furthermore, reading and writing can be done while holding using a predetermined feeding guide.

Further, in the description above, a case in which the RFID label T is produced by cutting with the cutter 51 the tag label tape 48 with print for which printing and accessing (reading or writing) of the RFID circuit element 60 are complete was given as an example, but this is not a limitation. In other words, in a case in which a label mount (a so-called die cut label) separated in advance to a predetermined size corresponding to the label is continuously disposed on the tape fed out from the roll, it is also possible for the label not to be cut using the cutter 51, but rather to peel only the label mount (a label mount containing the accessed RFID circuit element 60 for label production on which corresponding printing has been performed) from the tape after the tape has been discharged from the label discharge opening 7, thereby producing RFID labels T.

Further, in the description above, a system is used in which printing is done on a cover film 41 that is different from the base tape 37 comprising the RFID circuit element 60 and then these two are bonded, but this is not a limitation. Namely, the present disclosure may be applied to a system (which does not perform bonding) for printing on a print-receiving layer (a thermal layer, an image-receiving layer, a transfer layer) provided to a base tape. In this case, the same effect as in the present embodiment is obtained by appropriately changing the harmonization correlation associated with a roller (e.g., the platen roller) that feeds the base tape.

Furthermore, while in the description above, a case where the tag tape is wound around a reel member so as to form a roll, and the roll is disposed within the cartridge 3, and hence the tag tape is fed out from the cartridge has been described as an example, the present disclosure is not limited thereto. For example, an arrangement can be made as follows. Namely, a long-length or rectangular tape or sheet (including tape cut to a suitable length after being supplied from a roll) in which at least one RFID circuit element 60 is disposed is stacked (e.g., flat-stacked in a tray-like object) in a predetermined storage part so as to form a cartridge. The cartridge is then mounted to the cartridge holder of the tag label producing apparatus. Then, the tape or sheet is supplied or fed from the storage part, and printing or writing is performed, thereby producing RFID labels.

Furthermore, a configuration wherein the above-described roll is directly removably loaded to the tag label producing apparatus 1, or a configuration wherein a long, flat paper-shaped or strip-shaped tape or sheet is moved one piece at a time from outside the tag label producing apparatus 1 by a predetermined feeder mechanism and supplied to within the tag label producing apparatus 1 is also possible. Additionally, the structure of the roll is not limited to a type that is removable from the tag label producing apparatus 1 main body, such as the cartridge 3, but rather the base tape roll 36 may be provided as a so-called installation type or an integrated type that is not removable from the apparatus main body side. In each of these cases as well, the same effect is achieved.

Additionally, other than those previously described, approaches according to the respective embodiments and exemplary modifications may be utilized in combination as appropriate.

Note that various modifications which are not described in particular can be made according to the present disclosure without departing from the spirit and scope of the disclosure.

What is claimed is:

1. A printing apparatus comprising:

a feeding device that applies a driving force to feed a print-receiving medium;

a print forming device that performs a print forming process on said print-receiving medium fed by the driving force of said feeding device;

a harmonization correlation storing device that stores a reference property of said print-receiving medium or a bonding medium to be bonded to said print-receiving medium envisioned beforehand as a reference, a driving speed of said feeding device set beforehand corresponding to said reference property, and a print forming process operation of said print forming device set beforehand corresponding to said reference property, as a harmonization correlation;

a harmonization controlling portion that harmonizes and controls said driving speed and said print forming process operation, based on an input of print information according to an operation of an operator by using said harmonization correlation;

a detecting device that detects a property of said print-receiving medium or said bonding medium;

a property comparing portion that compares the property detected by said detecting device with said reference property stored in said harmonization correlation storing device; and a harmonization changing portion that changes said harmonization correlation according to a comparison result by said property comparing portion, wherein said print-receiving medium is a print-receiving tape, said printing apparatus further comprises a cartridge holder where a cartridge can be loaded and removed, said cartridge containing a print-receiving tape roll where said print-receiving tape is wound around, said detecting device detects a type of said cartridge loaded into said cartridge holder, said bonding medium is a base tape to be bonded to said print-receiving tape, and said cartridge holder is constituted so as to allow loading and removing of the cartridge containing said print-receiving tape roll and a base tape roll where said base tape is wound around, said harmonization changing portion comprises a print signal changing portion that changes a signal element of a print instruction signal that instructs said print forming process of said print forming device, said property includes a pull-out force with respect to said print-receiving tape or said base tape, and said harmonization changing portion either makes longer an output interval of the signal element of said print instruction signal with said print signal changing portion or makes higher the driving speed of said feeding device with said speed changing portion when said pull-out force with respect to said print-receiving tape or said base tape is large, and either makes shorter the output interval of the signal element of said print instruction signal with said print signal changing portion or makes lower the driving speed of said feeding device with said speed changing portion when said pull-out force with respect to said print-receiving tape or said base tape is small.

2. The printing apparatus according to claim 1, wherein:

said feeding device applies said driving force to a feeding roller that feeds said print-receiving tape or said base tape in a manner that said feeding roller contacts with said print-receiving tape or said base tape in a circumferential length of ¼ or more of a total circumference of the feeding roller.

3. The printing apparatus according to claim 1, wherein:

said harmonization changing portion changes the signal element of said print instruction signal with said print signal changing portion, without changing the driving speed of said feeding device.

4. The printing apparatus according to claim 1, wherein:

said harmonization changing portion comprises a speed changing portion that changes the driving speed of said feeding device.

5. The printing apparatus according to claim 4, wherein:

said harmonization changing portion changes the driving speed of said feeding device with said speed changing portion, without changing said signal element of said print instruction signal that instructs said print forming process of said print forming device.

6. The printing apparatus according to claim 1, wherein:

said property includes a thickness of said print-receiving tape or said base tape, said harmonization changing portion either makes longer the output interval of the signal element of said print instruction signal with said print signal changing portion or makes higher the driving speed of said feeding device with said speed changing portion when said thickness of said print-receiving tape or said base tape is small, and either makes shorter the output interval of the signal element of said print instruction signal with said print signal changing portion or makes lower the driving speed of said feeding device with said speed changing portion when said thickness of said print-receiving tape or said base tape is large.

7. The printing apparatus according to claim 1, wherein:

said property includes a width of said print-receiving tape or said base tape, said harmonization changing portion either makes longer the output interval of the signal element of said print instruction signal with said print signal changing portion or makes higher the driving speed of said feeding device with said speed changing portion when said width of said print-receiving tape or said base tape is small, and either makes shorter the output interval of the signal element of said print instruction signal with said print signal changing portion or makes lower the driving speed of said feeding device with said speed changing portion when said width of said print-receiving tape or said base tape is large.

8. The printing apparatus according to claim 1, wherein:

said property includes a type of said print-receiving tape or said base tape, said harmonization changing portion adjusts the output interval of the signal element of said print instruction signal with said print signal changing portion or adjusts the driving speed of said feeding device with said speed changing portion, according to said type of said print-receiving tape or said base tape.

9. The printing apparatus according to claim 8, wherein:

said cartridge holder allows loading and removing of said cartridge including either said print-receiving tape roll where said print-receiving tape is wound around or said base tape roll where said base tape is wound around, said print-receiving tape or said base tape being provided with an RFID circuit element comprising an IC circuit part that stores information and a tag antenna that transmits and receives information; and said property includes a presence or absence of said RFID circuit element at said print-receiving tape or said base tape, said harmonization changing portion adjusts the output interval of the signal element of said print instruction signal with said print signal changing portion or adjusts the driving speed of said feeding device with said speed changing portion, according to said presence or said absence of said RFID circuit element.

10. A printing apparatus comprising:

a feeding device that applies a driving force to feed a print-receiving medium;

a print forming device that performs a print forming process on said print-receiving medium fed by the driving force of said feeding device;

a harmonization correlation storing device that stores a reference property of said print-receiving medium or a bonding medium to be bonded to said print-receiving medium envisioned beforehand as a reference, a driving speed of said feeding device set beforehand corresponding to said reference property, and a print forming process operation of said print forming device set beforehand corresponding to said reference property, as a harmonization correlation;

a harmonization controlling portion that hannonizes and controls said driving speed and said print forming process operation, based on an input of print information according to an operation of an operator by using said harmonization correlation;

a detecting device that detects a property of said print-receiving medium or said bonding medium;

a property comparing portion that compares the property detected by said detecting device with said reference property stored in said harmonization correlation storing device; and a harmonization changing portion that changes said harmonization correlation according to a comparison result by said property comparing portion, wherein said print-receiving medium is a print-receiving tape, said printing apparatus further comprises a cartridge holder where a cartridge can be loaded and removed, said cartridge containing a print-receiving tape roll where said print-receiving tape is wound around, said detecting device detects a type of said cartridge loaded into said cartridge holder, said bonding medium is a base tape to be bonded to said print-receiving tape, and said cartridge holder is constituted so as to allow loading and removing of the cartridge containing said print-receiving tape roll and a base tape roll where said base tape is wound around, said harmonization changing portion comprises a print signal changing portion that changes a signal element of a print instruction signal that instructs said print forming process of said print forming device, said property includes a frictional force of said print-receiving tape or said base tape, and said harmonization changing portion either makes longer an output interval of the signal element of said print instruction signal with said print signal changing portion or makes higher the driving speed of said feeding device with said speed changing portion when said frictional force of said print-receiving tape or said base tape is small, and either makes shorter the output interval of the signal element of said print instruction signal with said print signal changing portion or makes lower the driving speed of said feeding device with said speed changing portion when said frictional force of said print-receiving tape or said base tape is large.

11. The printing apparatus according to claim 10, wherein:

said feeding device applies said driving force to a feeding roller that feeds said print-receiving tape or said base tape in a manner that said feeding roller contacts with said print-receiving tape or said base tape in a circumferential length of ¼ or more of a total circumference of the feeding roller.

12. The printing apparatus according to claim 10, wherein:

said harmonization changing portion changes the signal element of said print instruction signal with said print signal changing portion, without changing the driving speed of said feeding device.

13. The printing apparatus according to claim 10, wherein:

said harmonization changing portion comprises a speed changing portion that changes the driving speed of said feeding device.

14. The printing apparatus according to claim 13, wherein:

said harmonization changing portion changes the driving speed of said feeding device with said speed changing portion, without changing said signal element of said print instruction signal that instructs said print forming process of said print forming device.

15. The printing apparatus according to claim 10, wherein:

said property includes a thickness of said print-receiving tape or said base tape, said harmonization changing portion either makes longer the output interval of the signal element of said print instruction signal with said print signal changing portion or makes higher the driving speed of said feeding device with said speed changing portion when said thickness of said print-receiving tape or said base tape is small, and either makes shorter the output interval of the signal element of said print instruction signal with said print signal changing portion or makes lower the driving speed of said feeding device with said speed changing portion when said thickness of said print-receiving tape or said base tape is large.

16. The printing apparatus according to claim 10, wherein:

said property includes a width of said print-receiving tape or said base tape, said harmonization changing portion either makes longer the output interval of the signal element of said print instruction signal with said print signal changing portion or makes higher the driving speed of said feeding device with said speed changing portion when said width of said print-receiving tape or said base tape is small, and either makes shorter the output interval of the signal element of said print instruction signal with said print signal changing portion or makes lower the driving speed of said feeding device with said speed changing portion when said width of said print-receiving tape or said base tape is large.

* * * * *